United States Patent [19]

Junkers

[11] Patent Number: 4,706,526

[45] Date of Patent: Nov. 17, 1987

[54] FLUID OPERATED WRENCH

[76] Inventor: John K. Junkers, 7 Arrowhead La., Saddle River, N.J. 07458

[21] Appl. No.: 768,037

[22] Filed: Aug. 21, 1985

[51] Int. Cl.[4] ..... B25B 13/16

[52] U.S. Cl. ..... 81/57.39; 81/57.4

[58] Field of Search ..... 81/57.32, 57.39, 57.4

[56] References Cited

U.S. PATENT DOCUMENTS

| | | | |
|---|---|---|---|
| 3,706,244 | 12/1972 | Wilmeth | 81/57.32 |
| 4,132,136 | 1/1979 | Wilmeth | 81/57.39 |
| 4,385,533 | 5/1983 | Collins | 81/57.39 |
| 4,446,762 | 5/1984 | Junkers | 81/57.39 |

*Primary Examiner*—Frederick R. Schmidt
*Assistant Examiner*—Maurina Rachuba
*Attorney, Agent, or Firm*—Michael J. Striker

[57] ABSTRACT

A fluid-operated wrench for tightening and loosening threaded connectors comprises an action part having a turnable ratchet gear, and driving elements for turning the ratchet gear, and a reaction part arranged to counteract a reaction force created during tightening or loosening a threaded connector in one direction and tending to turn the action part in an opposite direction and including an attachment portion attachable to the action part and an abutment member arranged to abut against a stationary support during tightening or loosening of a threaded connector, wherein the attachment portion and the abutment member of the reaction part are formed as separate members engageable with one another so that the abutment member is movable relative to the attachment portion by a user.

10 Claims, 5 Drawing Figures

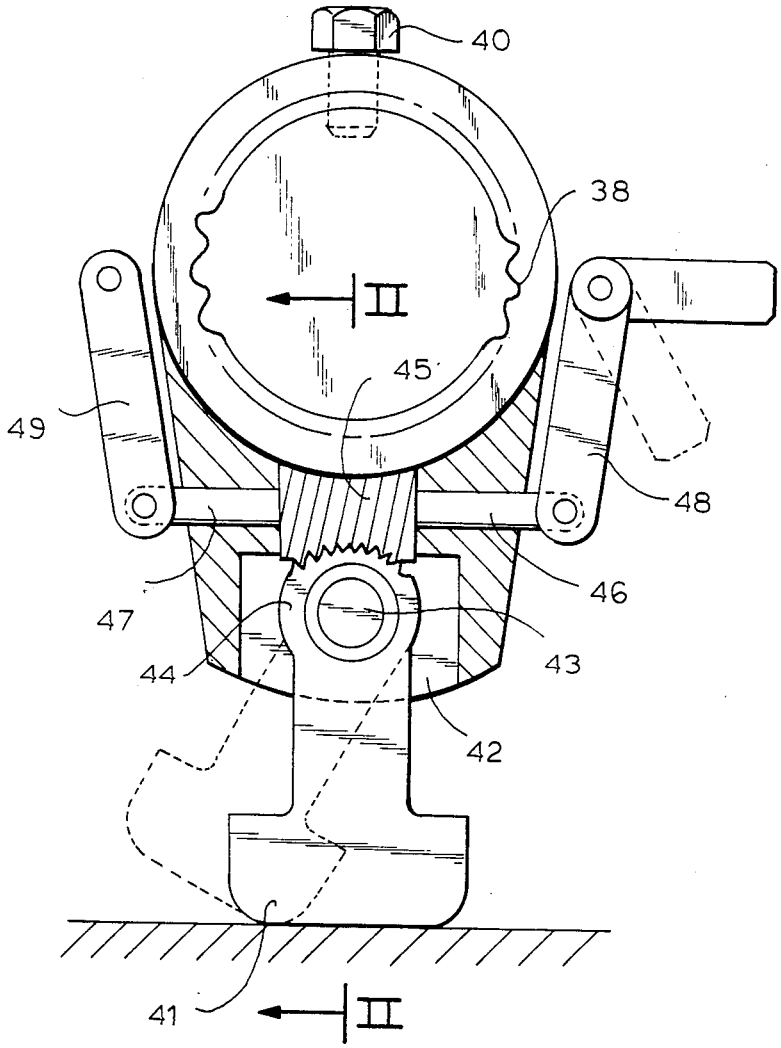
FIG. 4
FIG. 3
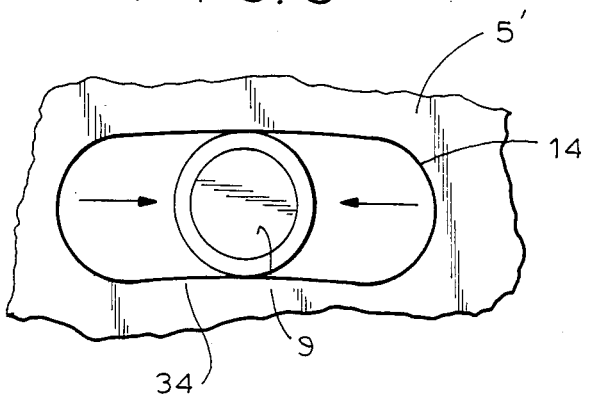

FLUID OPERATED WRENCH

BACKGROUND OF THE INVENTION

The present invention relates to a fluid operated wrench for tightening or loosening threaded connectors which for example connect a flange to a member or two flanges to each other.

Such wrenches are disclosed for instance in my U.S. Pat. Nos. 4,079,641 or 4,336,727. During tightening or loosening a threaded connector in which the nut is turned in one direction a reaction force is created which tends to turn the whole wrench in the opposite direction. To take up this reaction force, the wrenches as disclosed in the aforementioned patents are provided on its support with means for engaging a stationary member adjacent to the nut to be turned, which is usually a nut adjacent to that to be turned by the wrench, a flange adjacent to the nut to be turned etc. This engaging means is formed as a reaction plate connected to the support and engaging the stationary member with tremendous force. When the torsion force within the threaded connector which is opposite to the movement of the ratchet gear of the wrench during the active stroke is increased and forces the wrench when the ratchet gear is engaged against the reaction point, the wrench cannot be loosened and it has to be partially destroyed to be taken off the nut. It is to be understood that this operation is very complicated and connected with undesirable damage to the wrench.

SUMMARY OF THE INVENTION

Accordingly, it is an object of the present invention to provide a fluid operated wrench which avoids the disadvantages of the prior art.

More particularly, it is an object of the present invention to provide a fluid operated wrench which has a reaction member and is designed so that in the event if the wrench is stuck under the action of increased torsion within a threaded connector, it can be easily loosened without destroying its parts.

In keeping with these objects and with others which will become apparent hereinafter, one feature of the present invention resides, briefly stated, in a fluid-operated wrench which has an action part which has a turnable ratchet gear, and means for turning the ratchet gear, and an additional reaction part which has an attaching portion attachable to the action part and an abutment member arranged to abut against a stationary support during tensioning and loosening of a threaded connector, wherein the attaching portion and the abutment member are formed as separate members engageable with one another so that the abutment member is movable relative to the attaching portion.

When the fluid operated wrench is designed in accordance with the present invention, it is no longer necessary to destroy the wrench or its reaction part when the wrench is stuck due to increase of the torsion in the threaded connector. It is sufficient to turn the abutment member relative to the attaching portion of the reaction part in order to release the wrench.

The novel features of the present invention which are considered as characteristic are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is a view showing a pivot pin of one of driving pawls in accordance with another embodiment of the invention; and FIGS. 4 and 5 are axial and side view of a reaction part attached to a housing of an action par of the wrench.

DESCRIPTION OF A PREFERRED EMBODIMENT

Figure 1:
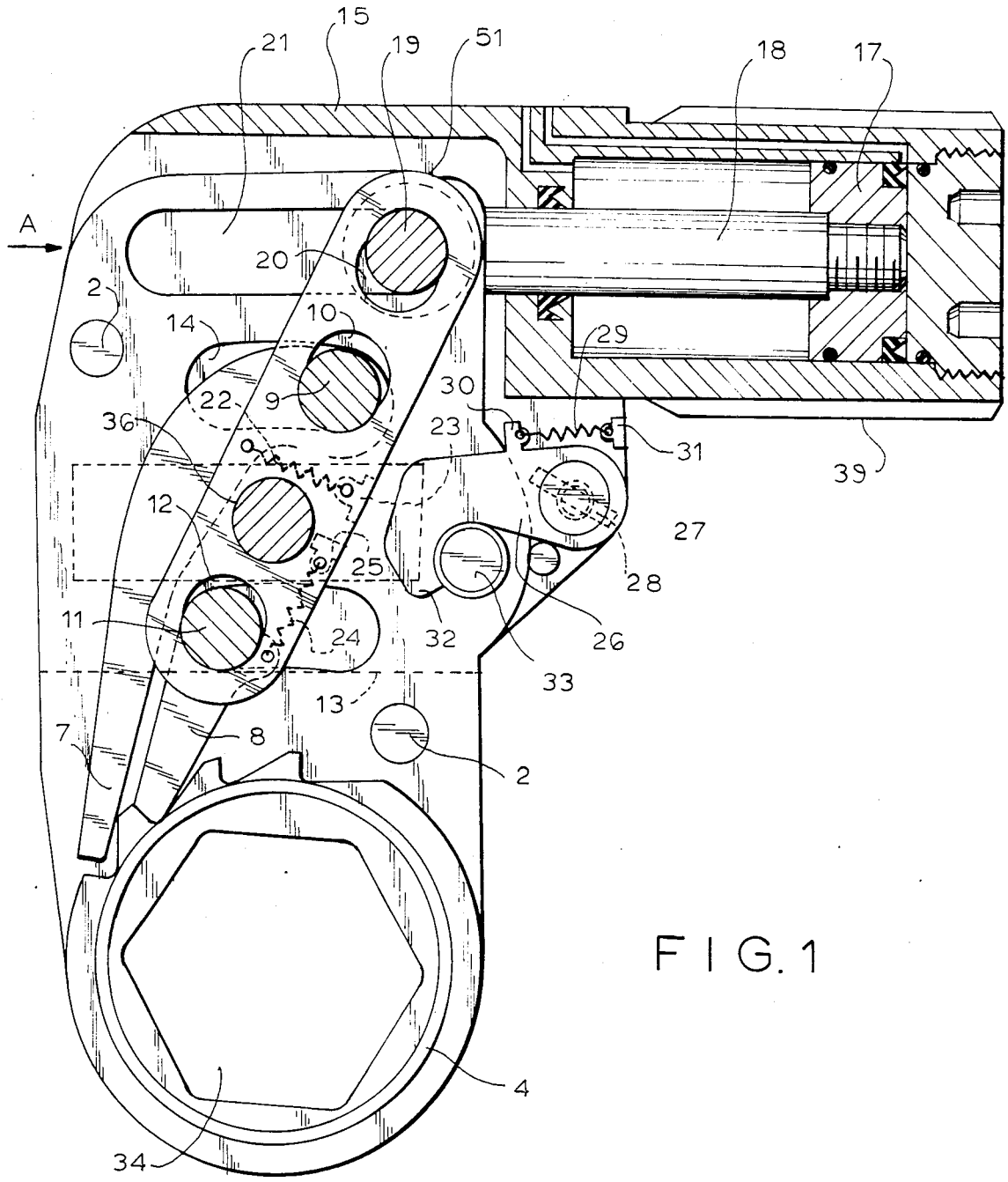
FIG. 1 is a view showing a cross-section of an action part of a fluid-operated wrench in accordance with the present invention, taken along the line I—I of the FIG. 2.

A fluid operated wrench in accordance with the present invention, formed for example as a hydraulic wrench, comprises support means including a pair of transversely spaced parallel support plates 1, 1' connected to each other in fixed relationship, for example by spacing pins 2. A ratchet gear 3 is mounted turnably about its axis between the support plates 1, 1'. For this purpose, the ratchet gear is provided with a pair of trunnions 4 projecting at opposite sides of the ratchet gear coaxially therewith and turnably mounted in corresponding bores of the support plates 1 and 1'. A pair of driving arms 5, 5' are sandwiched between opposite faces of the support plates 1, 1'. The driving arms 5, 5' are pivotally connected to the support plates 1, 1' by a pivot pin 6.

The wrench further comprises a pair of driving pawls 7 and 8 respectively having free ends engaging the teeth of the ratchet gear 3. The driving pawl 7 is pivotally carried in the region of the other end thereof on the driving arms 5, 5' by a pivot pin 9 which extends through bores 10 of the drive arms 5, 5'. The bores 10 are elongated in the direction of elongation of the driving arms of 5, 5' and are located at one side of the pivot pin 6. The other driving pawl 8 is pivotally carried in the region of the other end thereof on the drive arms 5, 5' by means of a pivot pin 11 which extends through bores 12 in the driving arms 5, 5'. The bores 12 are also elongated in the direction of elongation of the driving arms 5, 5' and located at the other side of the pivot pin 6.

The support plates 1, 1' are provided with elongated curved slots 13 and 14 which extend along two arcs of two circumferences described by two different radii with a center coinciding with the axis of the ratchet gear 3. The pivot pin 11 also extends through the curved slot 13 of the support plates 1, 1', while the pivot pin 9 also extends through the curved slot 14 of the support plates 1, 1'.

The fluid-operated wrench of the invention further has a one-piece housing with two housing parts 15 and 16. The housing part 15 is U-shaped and formed so that the upper portions of the plates 1, 1' can be inserted into the inner space of the housing part 15, preferably in abutting side-by-side relationship. The housing part 16 forms a cylinder of a fluid-operated cylinder-piston unit, for example a hydraulic cylinder-piston unit. A piston 17 reciprocates in the cylinder of the cylinder-piston unit and is connected to one end of a piston rod 18. The other end of the piston rod 18 is pivotally connected with the driving arms 5, 5' by a pivot pin 19. The pivot pin 19 extends through bores 20 which are elongated in the direction of elongation of the driving arms. The bores 20 are formed in the driving arms 5, 5' located at their ends which are distal from the ratchet gear 3. The support plates 1, 1' are provided with elongated slots 21 which are rectilinear and extend in the direction of reciprocation of the piston rod 18. The pivot pin 19 also extend through the slots 21 of the support plates 1, 1'.

Rollers 34 can be arranged on the pins 9, 11 and 19 for rolling in the respective bores 10, 12 and 20 of the driving arms 5, 5' and the slots 13, 14 and 21 of the support plates 1, 1' to reduce the frictions.

The bores 10, 12, 20 and a bore 36 for the pivot pins 9, 11, 19 and 36 are arranged so that during pivoting of the driving arm the distance between the centers of the pivot pins 19 and 6 changes in equal relation to the change of the distance between the centers of the pivot pins 9 and 11.

Biasing means are provided for biasing the driving pawls 7 and 8 toward the root circle of the ratchet gear. The biasing means can include, as shown in FIG. 1, a coil tension spring 22 engaging with its opposite ends the driving pawl 7 and an abutment 23 projecting from one of the driving arms 5 or 5', and a coil tension spring 24 engaging with its opposite ends the driving pawl 8 and another abutment 25 projecting from one of the drive arms. Conventional means, not shown in the drawing, are provided for alternatingly feeding pressure fluid, for instance, oil under pressure, into the cylinder of the cylinder-piston unit to opposite sides of the piston 17 therein, respectively discharging pressure fluid therefrom.

A catch 26 is pivotally mounted in the housing by means of a pivot pin 27 which can extend through bores of the housing part 15. The pin 27 is fixed with the catch 26 and provided at at least one end with a groove 28 for the purpose which will be explained herein below. A compression spring 29 engages with its opposite ends an abutment 30 of the catch 26 and an abutment 31 of the housing. The catch 26 has a hook-shaped portion 32 which is spaced from the pin 27, and the housing is provided with a pin 33 for cooperation with the hook-shaped portion.

The wrench in accordance with the present invention can be used for many purposes. A preferred use is to tighten or loosen a threaded connection. For the purpose, the trunnions 4 and the ratchet gear 3 are formed with a coaxial polygonal, for example hexagonal, passage 34 therethrough for engagement with the head of a threaded connection to be turned.

The operation of the above described wrench will be obvious from the description thereof. During the forward stroke of the piston 17 the piston rod 18 moves to the left in FIG. 1, the driving arms 5, 5' are turned in counterclockwise direction, the driving pawl 7 will drive the ratchet gear through a given angle in clockwise direction, whereas the driving pawl 8 will move backwards over a tooth of the ratchet gear. During the following return stroke of the piston 17, the piston rod 18 moves to the right, the driving arms 5, 5' are turned in clockwise direction, the driving pawl 8 will move the ratchet gear through a given angle in the same clockwise direction, whereas the driving pawl 7 will move back over a tooth of the ratchet gear. Since the opposite ends of the pawls 7 and 8 are connected with the driving arms 5, 5' by pins 9, 11 extending through the elongated bores 12, 12 and displaceable in the curved slots 14, 13, the free ends of the driving pawls cooperate with the teeth of the ratchet gear in substantially friction-free manner and the leverage of the driving pawls does not change during their active stroke. Since the pin 19 moves in the rectilinear slot 21 and in the elongated bore 20, the piston rod 18 performs exactly rectilinear movement which makes unnecessary pivotal attachment of the cylinder or the piston rod, and at the same time does not affect the piston seal.

Figure 2:
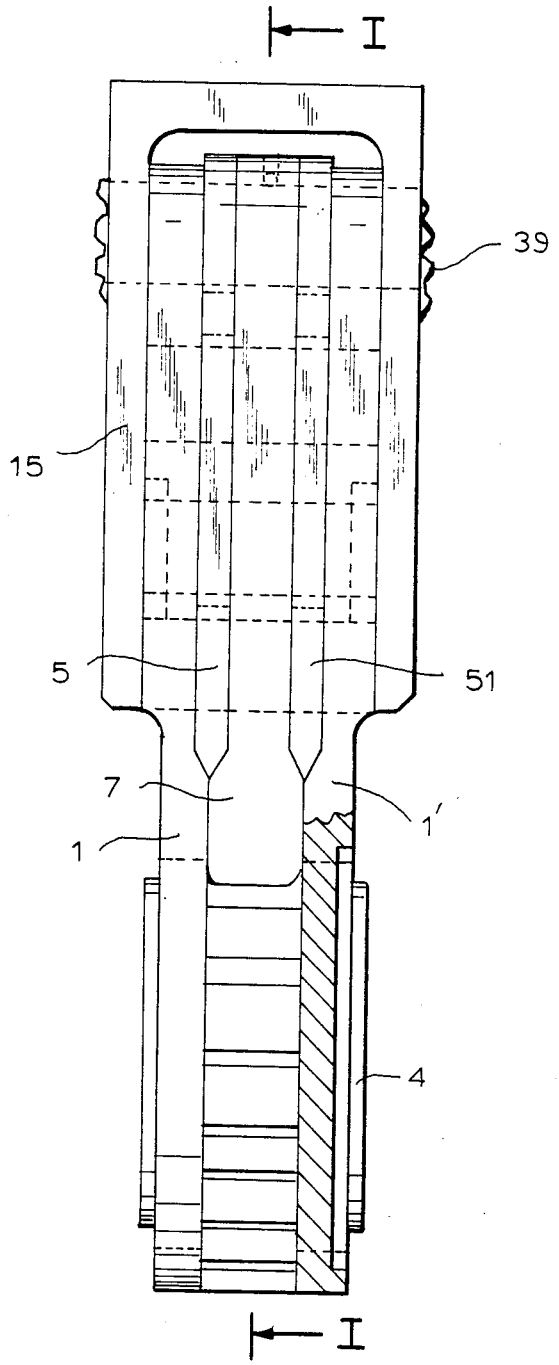
FIG. 2 is is a front view of the inventive fluid-operated wrench, as viewed in the direction of the arrow A of FIG. 1.

The wrench shown in the drawings comprises the support plates 1, 1' and the ratchet gear 3 formed so that it can be used as a limited clearance-type tool. As can be seen from FIG. 2, the axial distance between the outer surfaces of the lower portion of the support plates 1, 1' is small and therefore the ratchet gear can be introduced into narrow clearances. In order to use the wrench in accordance with the present invention as a standard socket-type tool, a screwdriver or another member can be inserted into the slot 28 of the pin 27 so as to turn the pin and the catch 26 connected therewith in clockwise direction in FIG. 1 and therefore disengage the hook-shaped portion 32 of the catch from the pin 33. Then the plates 1, 1' together with the driving arms 5, 5', the driving pawls 7, 8 and the ratchet gear 3 can be easily withdrawn from the inner space of the housing portion 15. Before the withdrawal the piston rod 18 must be disconnected from the driving arms 5, 5', for which purpose the pin 19 is formed so that it extends through bores provided in the lateral walls of the housing portion 15 and is removed by pushing in the axial direction of the pin.

For operating the inventive wrench as a standard socket-type tool, the lower part of the plates 1, 1' must be formed differently and provided with sockets. This is known and therefore not shown in the drawing. These socket-type plates together with the driving arms 5, 5' and the driving pawls 6, 7 are inserted into the space in the housing portion 15, and the hook-shaped portion 32 of the catch 26 snaps over the pin 33 under the action of the compression spring 29. Then the pin 19 is inserted for connecting the piston rod 18 with the driving arms 5, 5'. It is therefore clear that the inventive fluid-operated wrench can be easily converted from a limited clearance-type tool to a standard socket-type tool, and vice versa.

Figure 5:
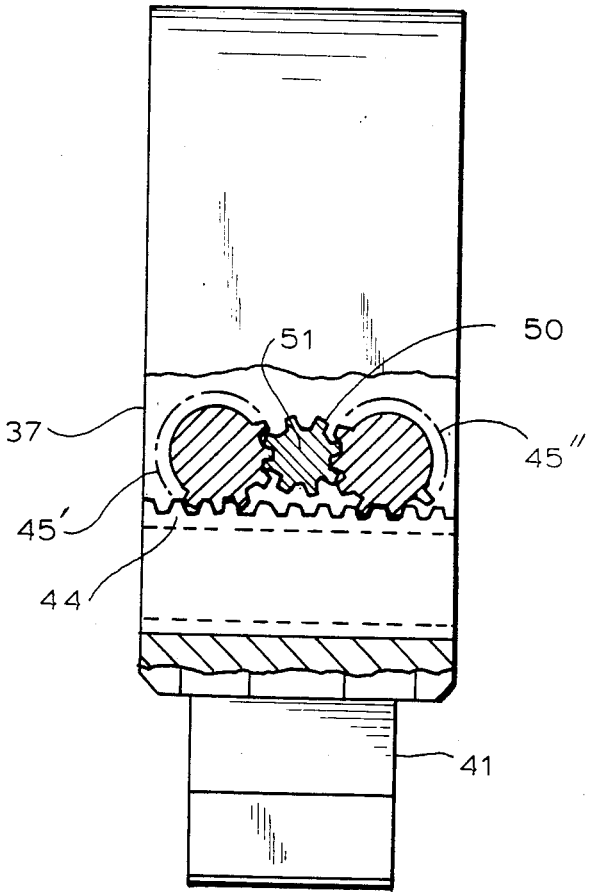

FIGS. 4 and 5 show a reaction part or reactor which can be attachable to the housing of the wrench in accordance with the present invention. It has a casing 37 provided with inner splines 38 which are engageable with outer splines 39 of the housing part 16. A bolt 40 secures the casing 37 on the housing part 16. An abutment member 41 is pivotally mounted in a groove 42 of the casing 37 by a pivot pin 43. The pivot pin 43 extends through a bore in the abutment 41 and more particularly in its portion which is formed as a worm gear 44. At least one worm 45 is turnably mounted in the casing 37 and its teeth engage the teeth of the worm gear 44. The worm 45 has two shaft portions 46 and 47 at its both axial ends. The shaft portions 46 and 47 are connected with cranks 48 and 49.

When for example the wrench in accordance with the present invention is used for engaging a polygonal head of a threaded connector to be turned, during such turning of a threaded connector in one direction a force is created tending to turn the housing in an opposite direction. The abutment member 41 of the reactor engages a periphery of a nut which is adjacent to the nut to be turned, a flange in which the threaded connector is to be turned etc., and counteracts the above mentioned force.

If the ratchet gear is stuck due to increased torsion in the threaded connector which is opposite to the turning of the ratchet gear during the active stroke and due to the reaction forces acting on the wrench, the wrench in accordance with the invention can be released by displacing the abutment member 41 in the respective direction and therefore disengaging the abutment member 41 from for example the nut, the flange etc. This can be done simply by turning of a respective one of the cranks 47, 48, whereby the worm 45 is turned via the shaft portions 46, 47 and turns the abutment member 41 in the required direction. It is no longer necessary to at least partially destroy the reaction member, as in the known fluid-operated wrenches.

It is to be understood that other types of engagement between the housing 37 and the abutment member 41 can be provided to allow loosening of the abutment member 41. The reaction part can have only one crank, and moreover other means for turning the worm 45 can be provided in it.

FIG. 5 shows another embodiment of the reaction part in accordance with the invention. The worm gear 44 is here in engagement with two worms 45' and 45" which are spaced from one another in the axial direction of the worm gear. The worms 45' and 45" engage with an intermediate gear 50 having a shaft portion 51. A not-shown crank which can be similar to the cranks 48, 49 is connected with the shaft portion 51. When the not-shown crank is rotated, for example manually by a user, both worms 45' and 45" are rotated in the same direction and turn the worm 44 and therefore the abutment member in the required direction for loosening of the abutment member 41 from a nut, a flange or the like against which it has been stuck.

It is to be understood that the reactor described herein above can be used in other wrenches with other action parts (including the ratchet gear and the driving pawls).

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated wrench for tightening or loosening threaded connectors comprising an action part having a ratchet gear mounted turnably about its axis and having a plurality of teeth, and driving means engageable with said teeth of said ratchet gear and turning the latter for tightening or loosening a threaded connector with a tightening or loosening force respectively; and a reaction part arranged to abut against a stationary support and to counteract a reaction force created during tightening or loosening a threaded connector by applying the reaction force to the stationary support in a predetermined direction, said reaction part including an attachment portion attachable to said action part, and an abutment member arranged to abut against a stationary support during tightening or loosening a threaded connector, said attachment portion and said abutment member of said reaction part being formed as two separate members engageable with one another so that said abutment member can be moved relative to said attachment portion and thereby withdrawn from the stationary support, said abutment member being turnable about an axis which extends transverse to the axis of turning of said ratchet gear; and means for moving said abutment member relative to said attachment portion, said moving means being separate from said driving means and operate independently from the latter, so that said driving means perform only the function of turning said ratchet gear of said action part without acting on said abutment member of said reaction part, while said moving means perform only the function of moving said abutment member of said reaction part without acting upon said ratchet gear of said action part.

2. A fluid-operated wrench as defined in claim 1, wherein said abutment member is turnable about an axis which extends transverse to the axis of turning of said ratchet gear.

3. A fluid-operated wrench for tightening or loosening threaded connectors comprising an action part having a ratchet gear mounted turnably about its axis and having a plurality of teeth, and driving means engageable with said teeth of said ratchet gear and turning the latter for tightening a threaded connector; a reaction part arranged to counteract a reaction force created during tightening or loosening a threaded connector in one direction and tending to turn said action part in an opposite direction, said reaction part including an attachment portion attachable to said action part, and an abutment member arranged to abut against a stationary support during tightening or loosening a threaded connector, said attachment portion and said abutment member of said reaction part being formed as two separate members engageable with one another so that said abutment member can be moved relative to said attachment portion and thereby withdrawn from the stationary support; means for engaging said abutment member with said attachment portion and formed as gear means having a plurality of gear members engageably with one another, said abutment member being turnable about an axis which extends transverse to the axis of turning of said ratchet gear; and means for moving said abutment member relative to said attachment portion.

4. A fluid-operated wrench as defined in claim 3, wherein said engageable gear members includes one gear member mounted in said attachment portion and another gear member mounted in said abutment member and engaging with said one gear member.

5. A fluid-operated wrench as defined in claim 4, wherein one of said gear members is formed as a worm gear, whereas the other of said gear members is formed as a worm engageable with said worm gear.

6. A fluid-operated wrench as defined in claim 4, wherein one of said gear members is formed as a worm gear having an axis and being elongated in an axial direction, whereas the other of said gear members is formed by two worms spaced from one another in said axial direction and engaging with said worm gear at two axially spaced locations.

7. A fluid-operated wrench as defined in claim 3; and further comprising means for moving at least of one of said gear members so as to turn said abutment member relative to said attachment portion, said moving means including an element connectable with said one gear member and actuatable by a user.

8. A fluid-operated wrench as defined in claim 7, wherein said moving means includes a crank connected with said one gear member and actuatable by a user so that by turning of said crank said one gear member is turned.

9. A fluid-operated wrench as defined in claim 3, wherein said abutment member is turnable about a pivot axis; and further comprising means for moving at least one of said gear members so as to turn said abutment member, said turning means including two turning elements extending from said gear member in two opposite directions relative to said pivot axis of said abutment member and each actuatable by a user.

10. A fluid-operated wrench for tightening or loosening threaded connectors comprising an action part having a ratchet gear mounted turnably about its axis and having a plurality of teeth, and driving means engageable with said teeth of said ratchet gear and turning the latter for tightening a threaded connector; a reaction part arranged to counteract a reaction force created during tightening or loosening a threaded connector in one direction and tending to turn said action part in an opposite direction, said reaction part including an attachment portion attachable to said action part, and an abutment member arranged to abut against a stationary support during tightening or loosening a threaded connector, said attachment portion and said abutment member of said reaction part being formed as two separate members engageable with one another so that said abutment member can be moved relative to said attachment portion and thereby withdrawn from the stationary support, said abutment member being turnable about an axis which extends transverse to the axis of turning of said ratchet gear; and means for moving said abutment member relative to said attachment portion, said moving means being separate and acting independently from said driving means.

* * * * *